United States Patent [19]

Baltensperger et al.

[11] 4,296,690

[45] Oct. 27, 1981

[54] HANGER FOR TRACK-TYPE SUSPENDED RAILWAY

[76] Inventors: Rudolf Baltensperger, Alte Keiserstuhlstr. 157, CH 8181 Höri; Hans B. Pfister, Frohhaldenstr. 20, CH 8180 Bülach, both of Switzerland

[21] Appl. No.: 956,654

[22] Filed: Nov. 1, 1978

[30] Foreign Application Priority Data

Nov. 11, 1977 [CH] Switzerland ..... 13779/77

[51] Int. Cl.[3] ..... E01B 3/00

[52] U.S. Cl. ..... 104/91; 104/111

[58] Field of Search ..... 104/111, 115, 89, 125, 104/116, 117, 123, 91, 92, 94, 95

[56] References Cited

U.S. PATENT DOCUMENTS

| | | | |
|---|---|---|---|
| 555,606 | 3/1896 | Louden | 104/111 |
| 1,531,075 | 3/1925 | Clubine | 104/111 |
| 3,092,326 | 6/1963 | Hohla | 104/111 |
| 3,095,174 | 6/1963 | Dehn et al. | 104/111 |
| 3,541,964 | 11/1970 | Harbert | 104/91 |
| 3,858,520 | 1/1975 | Patin | 104/91 |

*Primary Examiner*—Richard A. Bertsch
*Attorney, Agent, or Firm*—Karl F. Ross

[57] ABSTRACT

The suspension cable of a suspended railway lies in a vertical plane above the elongated track thereof. Hangers interconnecting the suspension cable and the track each have an upper part connected to the suspension cable, a lower part connected to the track, and an intermediate part pivoted on the upper and lower parts about respective horizontal upper and lower pivot axes. The lower pivot axis is perpendicular to the plane of the suspension cable and to the direction of elongation of the track, and is relatively close to the upper surface of the track. The upper pivot axis is generally parallel to the track and lies in the plane of the suspension cable, but is spaced from the upper surface of the track by a distance equal at least to the width of the track in a direction perpendicular to the plane thereof. Between these two pivot axes the intermediate part is completely rigid.

9 Claims, 1 Drawing Figure

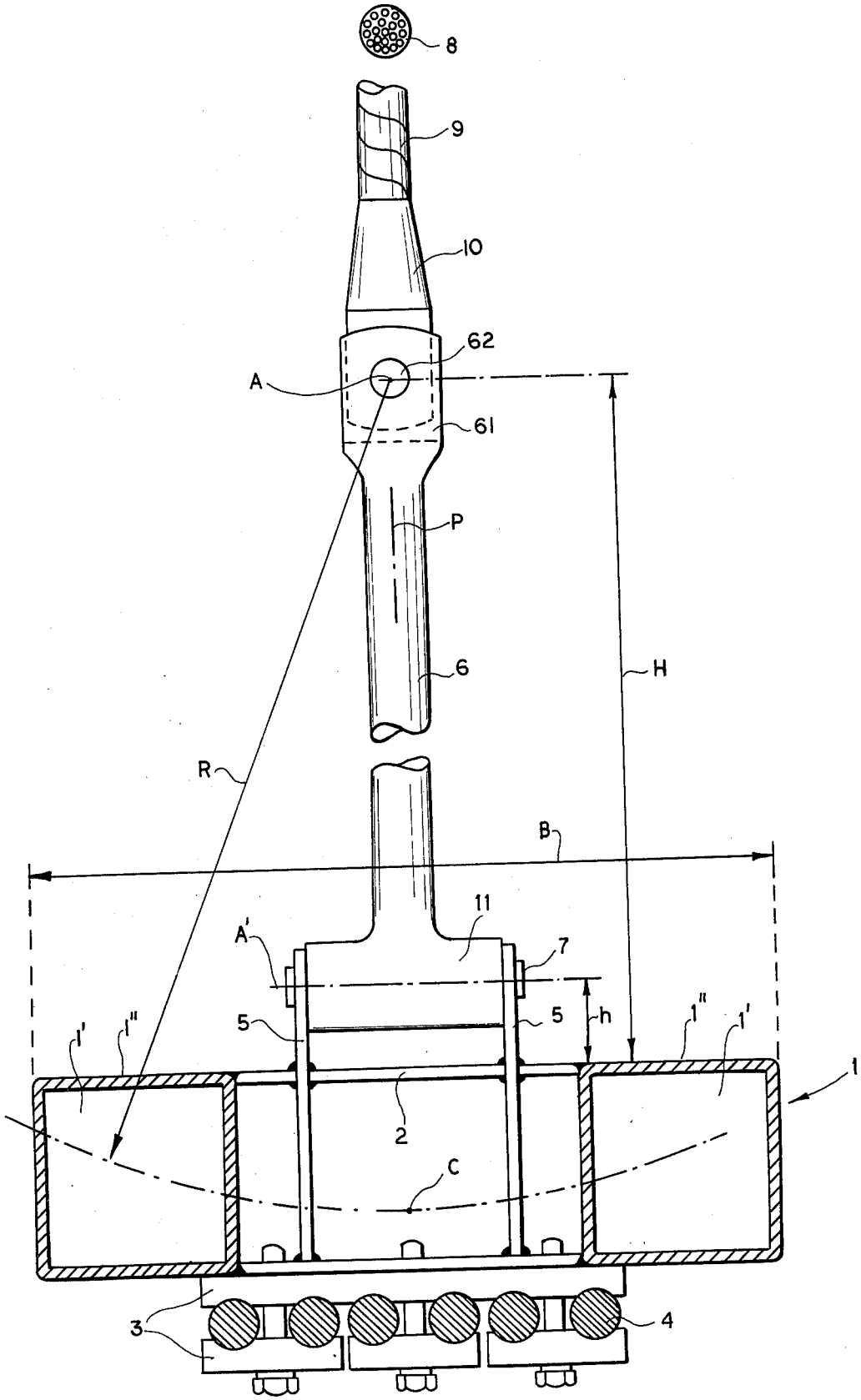
8
9
10
62
A
61
P
6
H
R
B
11
A'
7
5
5
h
1'
1"
1"
1'
1
2
C
3
4

HANGER FOR TRACK-TYPE SUSPENDED RAILWAY

FIELD OF THE INVENTION

The present invention relates to a hanger for a track-type suspension railway.

BACKGROUND OF THE INVENTION

A suspended railway has at least one upper suspension cable supported at intervals at towers and following a caternary path between the towers each of which is provided at its top with an upwardly convex carrying saddle over which the suspension cable passes (see copending application Ser. No. 956,652 filed Nov. 1, 1978. Suspended from this upper cable by means of a plurality of horizontally spaced upright cables or suspenders of different length is one or more lower track cables that define a generally straight and noncaternary path which may be level or inclined. In a light-duty low-speed system a passenger or freight car bogey or truck rides directly on the track cable.

In a heavy-duty system the track cable carries a rigid track (see now abandoned copending application Ser. No. 956,442 filed Nov. 1, 1978 on which the passenger or freight car rides (see German patent publication No. 1,905,686). Such a rigid track greatly decreases lateral sway, that is displacement of the track and car in a horizontal direction transverse of the direction of travel longitudinally along the cables, and permits heavy loads to be transported at high speeds.

The hangers for such a railway are normally simple pieces of cable having their upper ends secured to the suspension cable and their lower ends secured to eyes on the track. This type of suspension allows considerable displacement of the track relative to the suspension cable. In fact the ability of the track to twist about a horizontal axis generally parallel to the track and closely spaced from the upper surface thereof allows a high side wind to set the track vibrating in extremely hazardous manner that can prohibit any use of such a track.

A suspended railway system is normally provided at each of the towers with at least one reinforcement beam (see U.S. Pat. No. 4,208,969) which imparts to the track between the towers in the unloaded condition a negative curve, downward concavity, that is straightened out when these sections between the towers are loaded by the car traveling along the track (see German patent publication No. 2,149,871). Such a reinforcement beam is needed because it is impossible to provide hangers at the normal spacing directly under the tower whose saddle must permit at least limited longitudinal shifting of the cable. The amount of vertical deflection at the tower is minimal so that it is even possible to mount such a reinforcing beam on the tower.

Stations (see copending application Ser. No. 956,443 filed Nov. 1, 1978 must be provided along such a suspended railway for loading and unloading. Whether they are way stations through which the railway passes or terminal stations at which the transport path ends, such stations are invariably supported fixedly relative to the ground and are provided with stationary guide and support structure for the cars which must be fully stationary during any loading and unloading.

OBJECTS OF THE INVENTION

It is an object of this invention to provide an improved hanger for a suspended track-type railway.

Another object is to provide such a hanger which is compatible with the suspended railway described in the commonly owned and copending applications cited above, all of whose disclosures are herewith incorporated.

SUMMARY OF THE INVENTION

These objects are attained according to the present invention in a hanger having an upper part secured to the suspension cable, a lower part secured to the track below the upper part, an intermediate part between the upper and lower parts, and upper and lower pivots respectively interconnecting the upper and lower parts to the intermediate part. The upper pivot defines between the upper and intermediate parts a generally horizontal upper pivot axis extending generally in the plane in which the suspension cable lies and spaced at the hanger above the upper surface of the track by a vertical distance at least equal to the transverse width of the track at the upper surface thereof. The lower pivot defines between the intermediate and lower parts a lower pivot axis extending generally perpendicular to the plane and closely juxtaposed with the upper surface of the track at the hanger.

According to further features of this invention the upper and lower axis are vertically spaced apart by a fixed distance and the lower axes is spaced above the upper surface of the track by a distance equal to less than one-third of the width of the track.

According to this invention the track is a pair of generally parallel hollow beams having upper sides constituting the upper surface. The intermediate part of the hanger is a rigid T-shaped bar so that a plane passing longitudinally along the bar and including one of the pivot axes will always be perpendicular to the other pivot axis.

With the system according to the instant invention a relatively close spacing of the lower pivot axis to the track and the relatively larger spacing of the upper pivot axis from the track greatly increases the period the track would have if it oscillated from side to side. The amount of force necessary for such oscillation would be correspondingly increased and, therefore, the horizontal oscillation of the track is largely eliminated by the hanger according to this invention. The system is extremely rugged so that considerable forces can be withstood and the system is capable of high-speed use with relatively heavy loads.

BRIEF DESCRIPTION OF THE DRAWING

The sole FIGURE of the drawing is a vertical transverse section through a portion of a railway according to this invention showing the hanger thereof.

SPECIFIC DESCRIPTION

The hanger according to the present invention is adapted to extend between a suspension cable 8 lying generally in a plane P and a track 1. The track 1 as described in the above-described copending applications basically comprises a pair of parallel square-section box girders 1' having coplanar horizontal upper surfaces 1'' and interconnected by webs 2 so that the upper surfaces 1'' have a transverse width B. Extending along underneath this track 1 is a plurality, here six, of cables 4 secured in clamps 3 and longitudinally tensioned to stiffen and rigidify the track 1. The track 1 is furthermore formed at the web 2 with a pair of upstanding lugs 5 constituting the lower part of the hanger.

A cable 9 provided at its lower end with a swaged fitting 10 constitutes the upper part of the hanger and an intermediate T-part 6 interconnects these two. To this end the intermediate part 6 has at its lower end a transverse portion 11 defining a pivot axis A′ extending parallel to the upper surfaces 1″ and perpendicular to the plane P. A pin 7 journaled in the two lugs 5 and passing through the portion 11 lies on this axis A′.

At its upper end the intermediate part 6 has a fork 61 provided with a pivot pin 62 journaled in the fitting 10 and defining an axis A lying in the plane P and also parallel to the surfaces 1″. The vertical spacing H between the axis A and the surface 1″ is greater by approximately one-tenth than the transverse width B. Thus if a laterally effective force is exerted on the track 1 the center C of gravity thereof will move along an arc having a radius R which is relatively long. Thus a considerable force will be needed to laterally deflect the track 1 and high-speed vibration of the track 1 will be impossible. The lower axis A′ is spaced by a distance h equal to less than one-third of the distance H, and here equal approximately to one-ninth of this distance H from the surfaces 1. In reality the spacing h is made as small as possible for maximum flexibility, since longitudinal displacement of the track 1 is almost impossible and there is no need to hinder what little displacement there might be.

We claim:

1. In a suspended railway having at least one suspension cable lying generally in a vertical plane and an at least generally horizontally elongated track formed by a pair of generally parallel hollow beams having upper sides constituting an upper surface and a predetermined transverse horizontal width and lying generally in said plane below said cable, a hanger comprising:

an upper part secured to said suspension cable;

a lower part secured to said track below said upper part;

a rigid T-shaped intermediate part between said upper and lower parts;

an upper pivot interconnecting said upper and intermediate parts and defining therebetween a generally horizontal upper pivot axis extending generally in said plane and spaced at said hanger above said upper surface of said track by a vertical distance at least equal to said transverse width; and a lower pivot interconnecting said intermediate and lower parts and defining therebetween a lower pivot axis extending generally perpendicular to said plane and closely juxtaposed with said upper surface at said hanger, said pivot axes being relatively fixed and immovable relative to each other.

2. The hanger defined in claim 1 wherein said lower axis is spaced above said upper surface by a distance equal to less than one-third of said width.

3. The hanger defined in claim 1 wherein said intermediate part is rigid.

4. In a suspended railway having at least one suspension cable lying generally in a vertical plane and an at least generally horizontally elongated track having an upper surface and a predetermined transverse horizontal width and lying generally in said plane below said cable, a hanger comprising:

an upper part secured to said suspension cable;

a lower part secured to said track below said upper part;

a rigid T-shaped intermediate part between said upper and lower parts;

an upper pivot interconnecting said upper and intermediate parts and defining therebetween a generally horizontal upper pivot axis extending generally in said plane and spaced at said hanger above said upper surface of said track by a vertical distance at least equal to said transverse width; and a lower pivot interconnecting said intermediate and lower parts and defining therebetween a lower pivot axis extending generally perpendicular to said plane and closely juxtaposed with said upper surface at said hanger, said pivot axes being relatively fixed and immovable relatively to each other.

5. The hanger defined in claim 4 wherein said track is a pair of generally parallel hollow beams having upper sides constituting said upper surface.

6. The hanger defined in claim 4 wherein said lower part is fixed on said track and said lower axis is fixed relative to said track.

7. The hanger defined in claim 6 wherein said upper axis lies in said plane and said lower axis is perpendicular to said plane.

8. The hanger defined in claim 4 wherein said intermediate part is a metal rod.

9. The hanger defined in claim 8 wherein said upper part includes a vertical cable.

* * * * *